United States Patent [19]

Ito

[11] 4,265,054

[45] May 5, 1981

[54] INTERNAL GRINDING MACHINE

[75] Inventor: Shohei Ito, Tokyo, Japan

[73] Assignee: Seiko Seiki Kabushiki Kaisha, Tokyo, Japan

[21] Appl. No.: 869,428

[22] Filed: Jan. 16, 1978

Related U.S. Application Data

[63] Continuation of Ser. No. 613,876, Sep. 16, 1975, abandoned.

[30] Foreign Application Priority Data

Sep. 17, 1974 [JP] Japan ..... 49-107463
Oct. 4, 1974 [JP] Japan ..... 49-114405

[51] Int. Cl.[3] ..... B24B 5/06

[52] U.S. Cl. ..... 51/5 D; 51/105 R; 51/165.93; 51/3

[58] Field of Search ..... 51/3, 5 D, 105 R, 165.83, 51/165.87, 165.93, 327

[56] References Cited

U.S. PATENT DOCUMENTS 3,430,388 3/1969 Gabrielli ..... 51/3
3,924,355 12/1975 Tatsumi et al. ..... 51/3
3,939,609 2/1976 Wasco, Jr. ..... 51/5 D

*Primary Examiner*—James G. Smith
*Attorney, Agent, or Firm*—Robert E. Burns; Emmanuel J. Lobato; Bruce L. Adams

[57] ABSTRACT

An internal grinding machine having two grinding wheel spindles each of which has a grinding wheel for grinding a part of the inner or end surfaces of a workpiece. The workpiece is ground by both the wheels while it is held in a work spindle. The machine includes a wheel carrier assembly comprising a first wheel carrier table slidable in a direction on the machine base and being provided with a dressing infeed mechanism and an infeeding mechanism for the wheel spindle which is to grind the taper or face of the workpiece, and a second wheel carrier table slidable in a proper direction on the first wheel carrier table and having the grinding wheel spindles adjustably mounted thereon. The machine further includes a shift-infeed table having the work spindle thereon. The shift infeed is provided with a dressing infeed mechanism and an infeeding mechanism for the other wheel spindle.

6 Claims, 21 Drawing Figures

FIG. 17
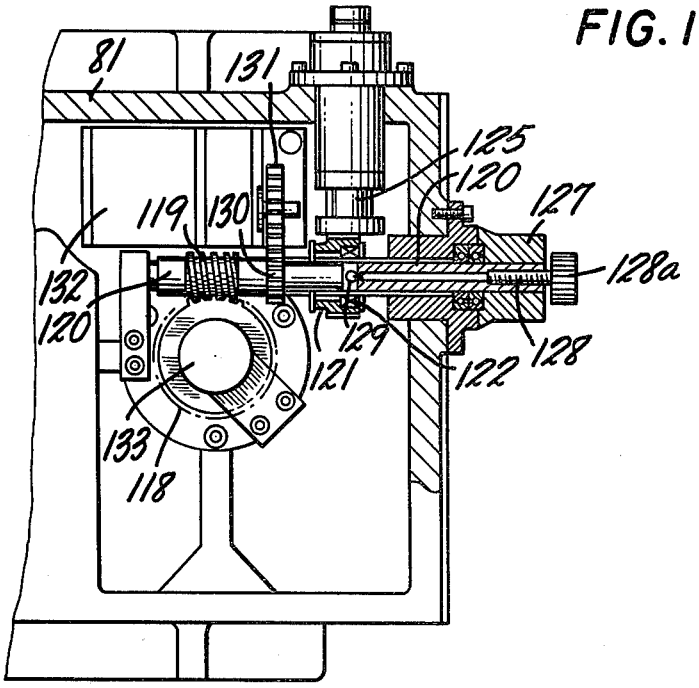
FIG. 18
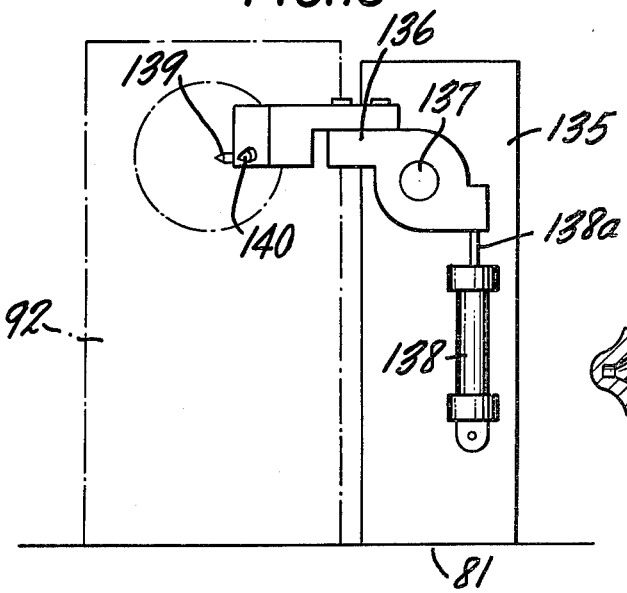
FIG. 19
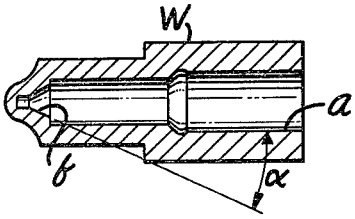
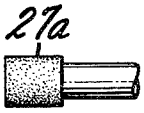
FIG. 19A
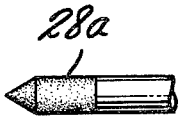
FIG. 19B

INTERNAL GRINDING MACHINE

This is a continuation, of application Serial No. 613,876, filed Sept. 16, 1975 now abandoned.

BACKGROUND OF THE INVENTION

The present invention relates to an internal grinding machine, and more particularly, to an improvement of a machine for grinding a plurality of concentric inner or end surface of a workpiece by means of grinding wheels.

Applicant has proposed an internal grinding machine with reference to this multi-wheel-spindle internal grinding machine in U.S. patent application Ser. No. 325,102 in which one infeeding mechanism in a shift table is used for infeeding to multiple grinding wheels. But a suitable infeeding speed for grinding or dressing varies in response to the grinding wheel geometry, the workpiece geometry, its ground area, its expected surface finish as well as other conditions. Single infeeding mechanism is not suitable for giving a plurality of infeeding speeds as it requires complicated control.

SUMMARY OF THE INVENTION

Therefore, it is the principal object of this invention to provide an internal grinding machine in which suitable infeed speed for grinding or dressing is given to each of grinding wheels.

It is another object of the invention to provide an internal grinding machine in which reciprocating motion for a grinding wheel which grinds the taper bore or face is attained in any reciprocating direction with a simple reciprocating mechanism.

These and other objects have been attained by the machine which comprises a pair of infeeding mechanisms, one of which is provided for a wheel carrier table and the other is for a shift infeed table which has a work spindle head.

BRIEF DESCRIPTION OF THE DRAWINGS:

The drawings show a preferred embodiment of the invention in which FIG. 17 is a sectional plan view showing a dressing infeed driving mechanism for inner cylindrical grinding, FIG. 18 is an elevational view of a dressing mechanism, FIG. 19 is a sectional view of a workpiece, FIG. 19A is an accompanying grinding wheel for a workpiece in FIG. 19, and FIG. 19B is an additional grinding wheel for a workpiece in FIG. 19.

Figure 1:
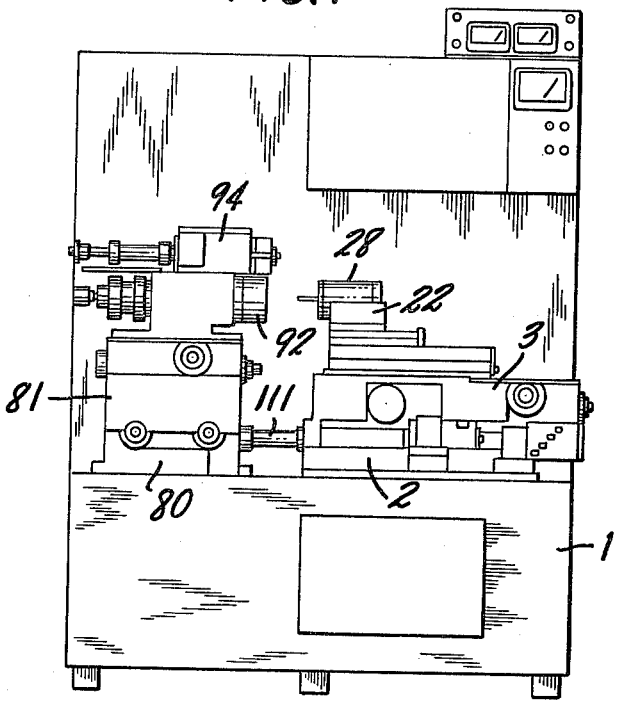
FIG. 1 is a front view showing an internal grinding machine according to the invention.
Figure 2:
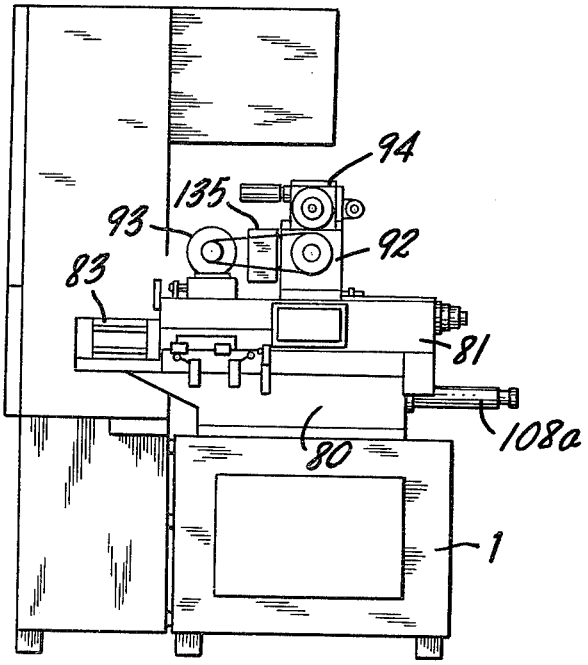
FIG. 2 is a left side view of the machine shown in FIG. 1.
Figure 3:
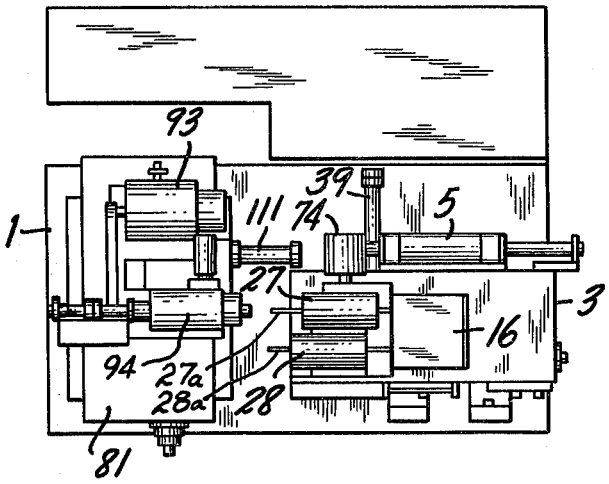
FIG. 3 is a plan view of the machine shown in FIGS. 1 and 2.
Figure 4:
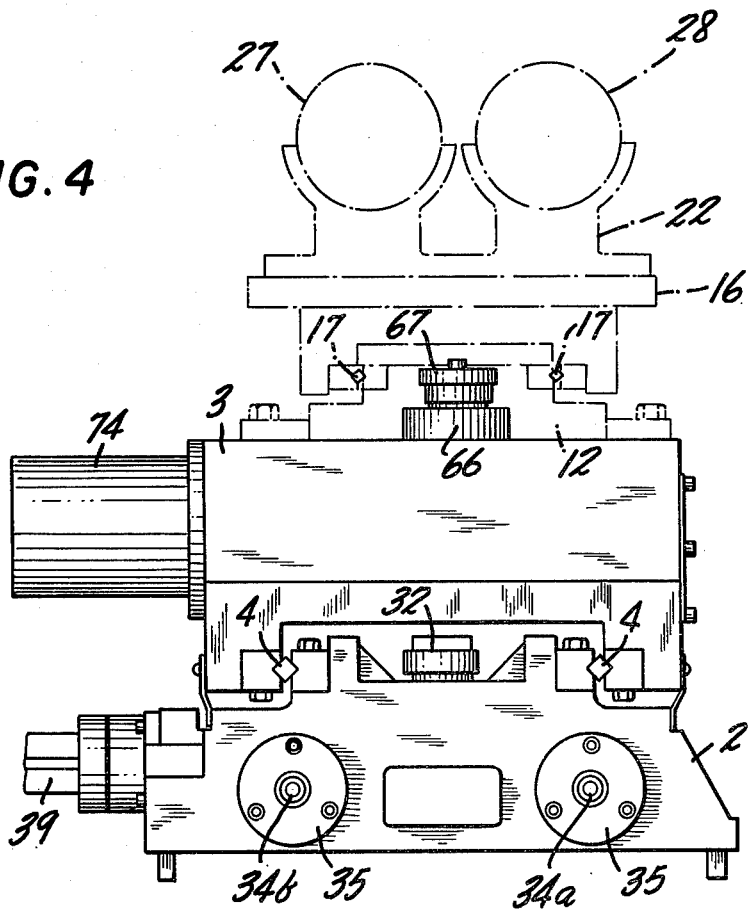
FIG. 4 is a left side view showing the wheel carrier construction of the machine shown in FIGS. 1 to 3.
Figure 5:
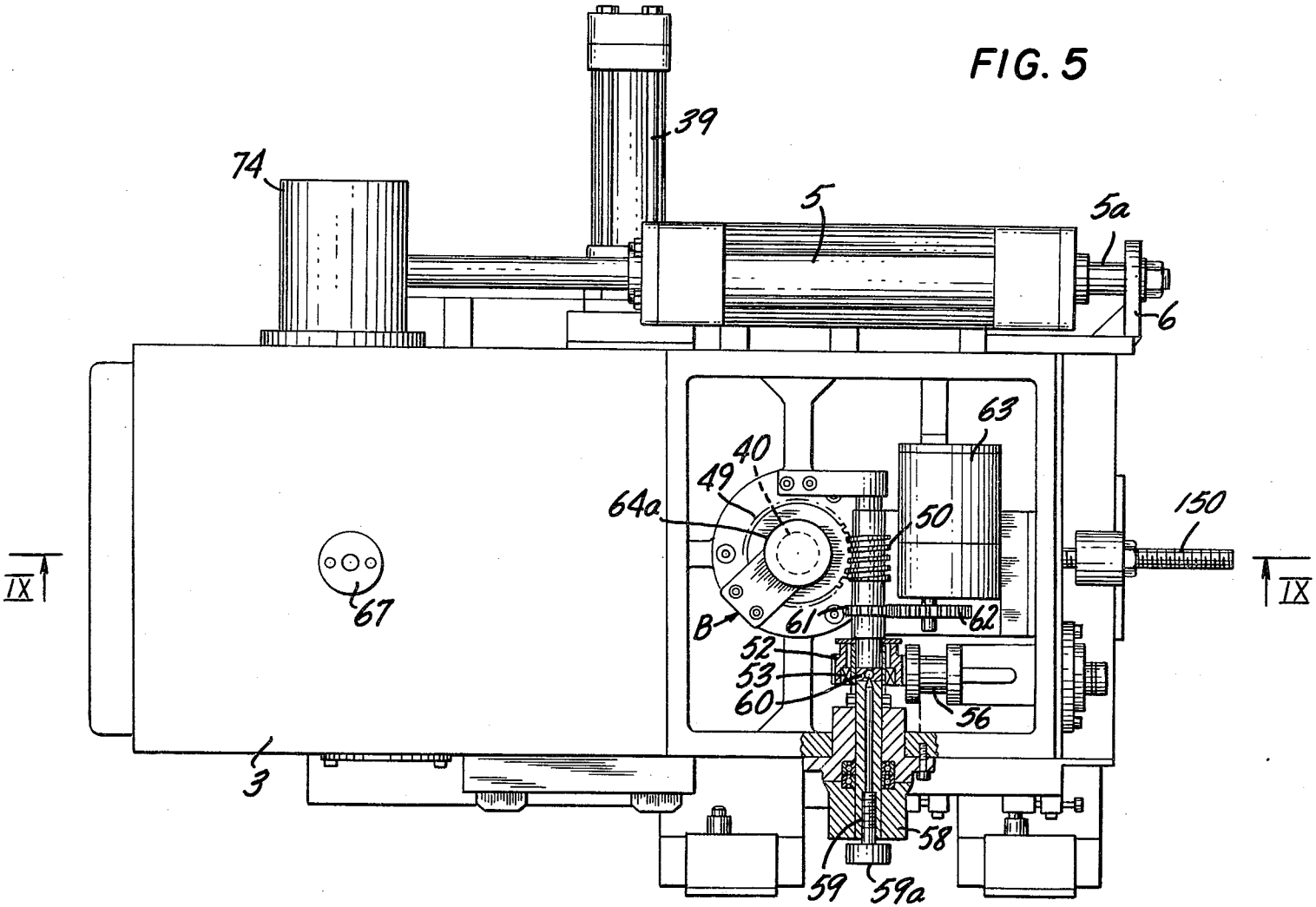
FIG. 5 is a partially cut-away plan view showing a first wheel carrier table in the wheel carrier construction.
Figure 6:
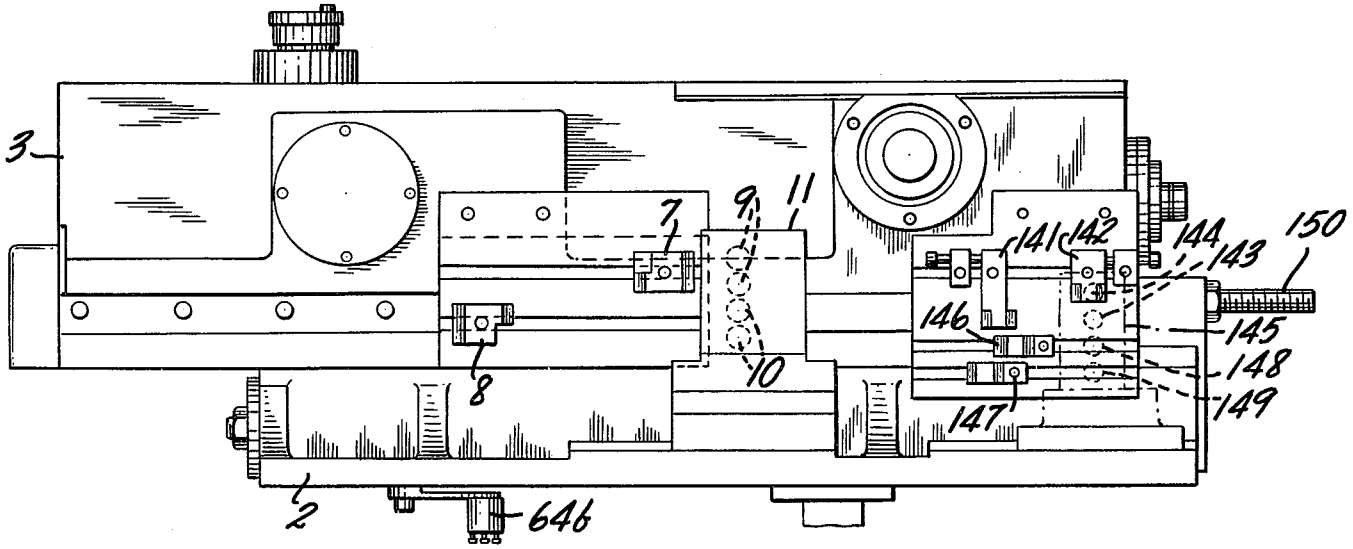
FIG. 6 is a front view of the first wheel carrier table.

DETAILED DESCRIPTION OF THE PREFERRED EMBODIMENT:

A preferred embodiment according to this invention will be described referring to the accompanying drawings, in which FIGS. 1 to 3 show a wholly illustrated internal grinder comprising a base 1 on one side of which there is mounted a table stand 2. A first wheel carrier table 3 is slidably supported by table stand 2 by way of roller guide members 4 which are, as shown in FIG. 4, placed in table stand 2. A hydraulic cylinder 5 is mounted on table stand 2, as shown in FIG. 5, on the rear side thereof, an end of a piston rod **5*a* of hydraulic cylinder 5 being connected to first wheel carrier table 3 through a connecting bracket 6 so as to drive the carrier table 3. A dog 7 to detect the forward return position of first wheel carrier table 3 and a dog 8 to detect the backward return position of the table 3 are mounted adjustable, as shown in FIG. 6, on the front side of first wheel carrier table 3. A pair of limit switches 9 and 10 are mounted on the abutment 11 of table stand 2**.

Figure 7:
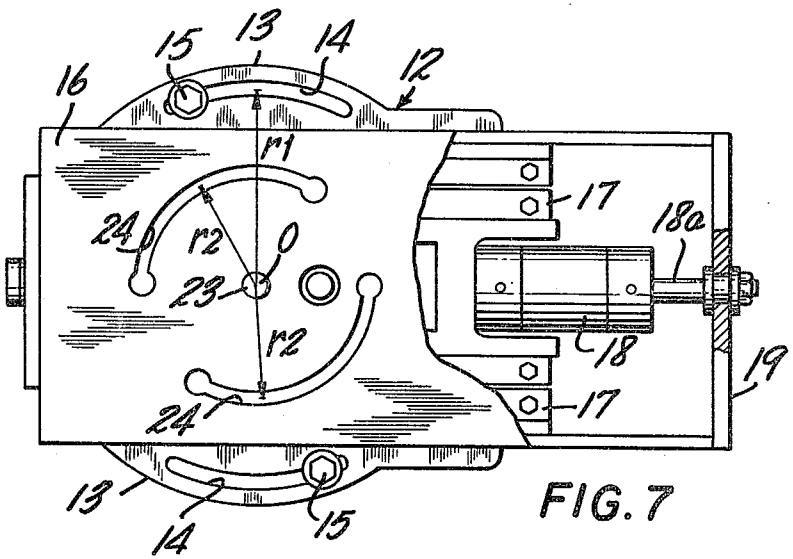
FIG. 7 is a partially cut-away plan view showing a second wheel carrier table in the wheel carrier construction.

A swivel table 12 is mounted on the front portion of first wheel carrier table 3, swivel table 12 being provided with sector portions 13 protruded from both sides of it as shown in FIG. 7. Each of sector portions 13 has an arc-shaped slot 14 which is extended about sixty degrees around the swiveling center 0 of swivel table 12 with radius $r_1$. A bolt 15 penetrates through each of the slots 14, bolt 15 being to be screwed up with first wheel carrier table 3 so as to fix swivel table 12 securely on the carrier table 3.

Figure 8:
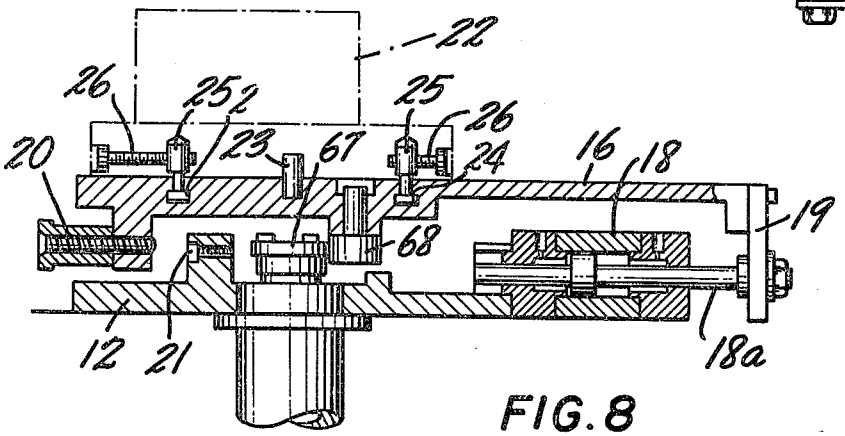
FIG. 8 is a longitudinal sectional view of the second wheel carrier table.

On swivel table 12 there is mounted a second wheel carrier table 16 which is slidably supported in the longitudinal direction through roller guide members 17 as shown in FIGS. 4 and 8, an end of a piston rod **18*a* of a hydraulic cylinder 18 mounted on swivel table 12 being connected to the rear end of second wheel carrier table 16 through a connecting bracket 19 so as to drive the second carrier table 16. An abutment member 20 is mounted on the front portion of second carrier table 16, abutment member 20 being contactable with a stopper 21 which is mounted on swivel table 12 so as to locate the second carrier table 16 at the end of its stroke when cylinder 18 pushes second carrier table 16** backwardly.

A wheel head 22 is mounted on second wheel carrier table 16, wheel head 22 being swingable around a pivot 23 which is projected from the table 16 in the common axis with the swiveling center 0 of swivel table 12, when second carrier table 16 is located at the forward end of its stroke. A pair of arc-shaped T-slots 24 are formed on the contact surface of second wheel carrier table 16, each of the T-slots 24 extends about ninety degrees around pivot 23 with radius $r_2$. A connecting member 25 is inserted slidable in each T-slot 24, the protruded portions of each connecting member 25 penetrating into wheel head 22. Screws 26 are screwed horizontal in wheel head 22, with the eccentric portions laterally penetrating through the corresponding connecting member 25 so as to clump wheel head 22 on second wheel carrier table 16 with turning operation of screws 26.

On wheel head 22 there are mounted a first wheel head 27 for grinding inner cylindrical portion "a" of a workpiece W as shown in FIG. 19 and a second wheel head 28 for grinding inner tapered portion "b", with a proper distance between them.

Figure 9:
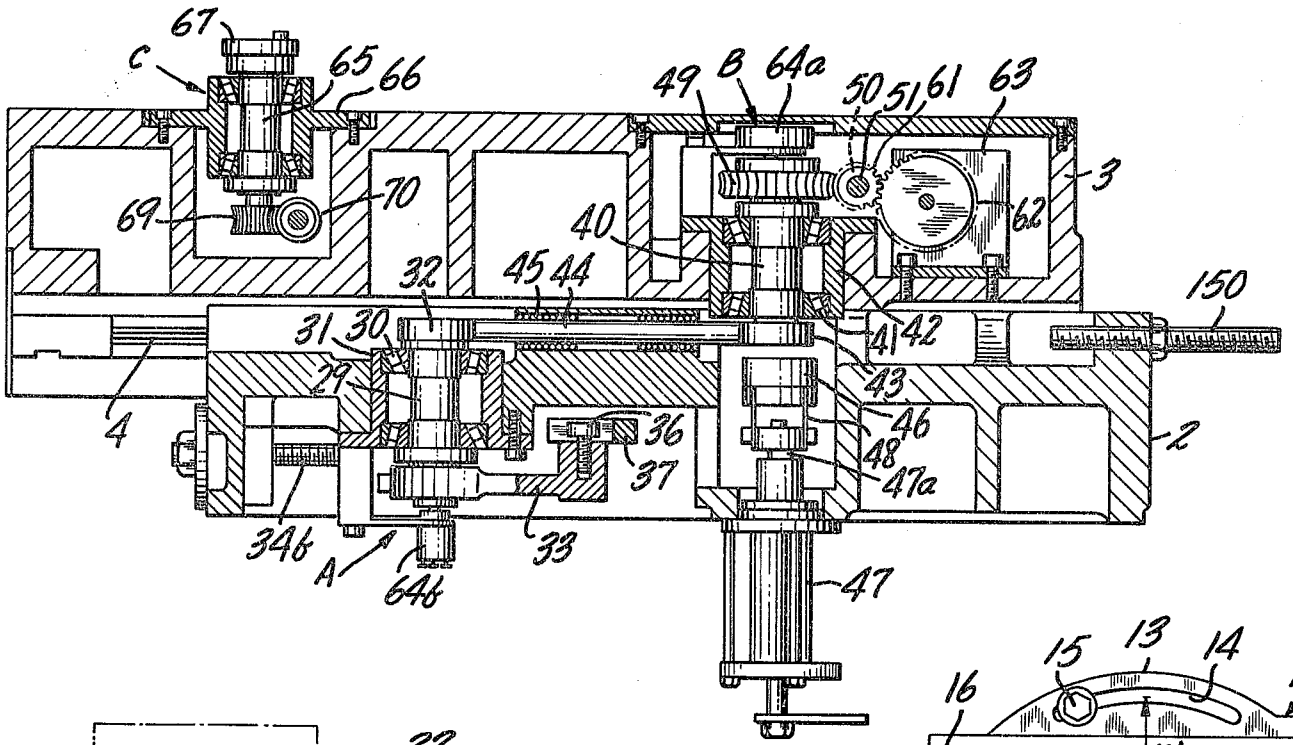
FIG. 9 is a longitudinal sectional view taken on line IX—IX in FIG. 5.
Figure 10:
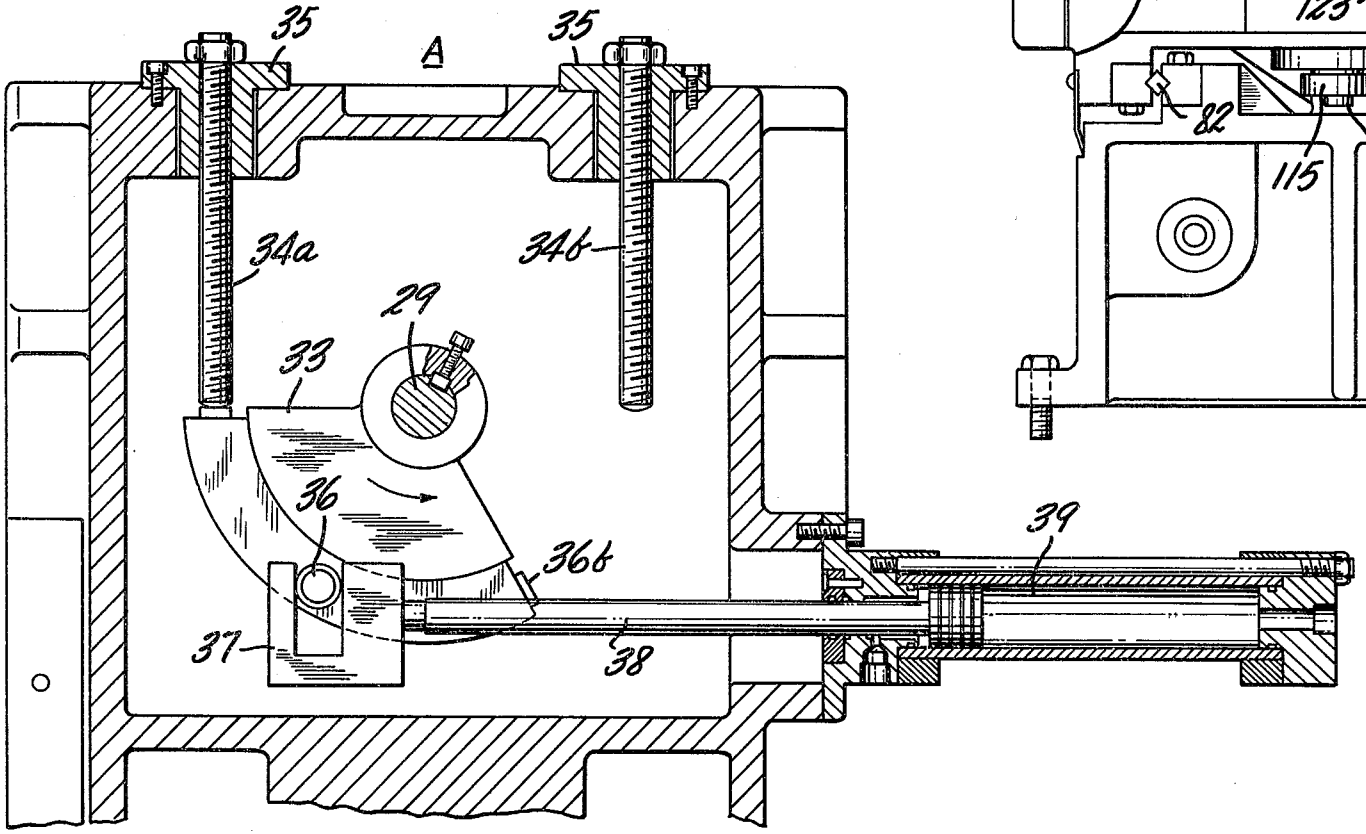
FIG. 10 is a plan view showing an infeed driving mechanism for taper grinding.

FIG. 9 is a sectional view showing an infeed mechanism A for grinding operation of inner tapered portion "b", a dressing infeed mechanism B for dressing a grinding wheel 28*a* used for tapered portion "b" and a reciprocationg mechanism C. Infeed mechanism A includes an infeeding shaft 29 which is supported rotatable and vertical with bearings 30 in a bracket 31, bracket 31 being fixed on table stand 2. Infeeding shaft 29 has an eccentric disc cam 32 securely fixed on the upper end and a sector plate 33 with its boss securely fixed on the lower end as shown in FIG. 10. A pair of stopper screws 34*a* and 34*b* are screwed respectively to brackets 35 which are fixed on the front wall of table stand 2, stopper screws 34*a* and 34*b* being adjustable in the longitudinal direction so as to locate sector plate 33 at both the end of its swivel stroke (infeed stroke), respectively contacting their top ends with stoppers 36*a* and 36*b*.

Sector plate 33 has a pin 36 protruded in parallel with its axis from the middle on the sector arc, pin 36 being held by a fork 37 which is securely fixed on the top end of a piston rod 38 of a hydraulic cylinder 39, hydraulic cylinder 39 being mounted on a side wall of table stand 2, so that hydraulic cylinder 39 drives infeeding shaft 29 to rotate with eccentric disc cam 32 thereby infeeding first wheel carrier table 3.

The dressing infeed mechanism B for a dresser which dresses a grinding wheel 28*a* of second wheel spindle 28 is arranged in the rear portion of first wheel carrier table 3. Dressing mechanism B includes an infeeding shaft 40 which is supported rotatable and vertical with bearings 41 in a bracket 42, bracket 42 being fixed on first wheel carrier table 3. Infeeding shaft 40 has an eccentric disc cam 43 securely fixed on the bottom end of it. A transmitting rod 44 is supported slidable by sliding bearings 45 in table stand 2, between eccentric disc cam 43 and another eccentric disc cam 32 of infeeding mechanism A, transmitting rod 44 being in contact with eccentric cam 32 and with eccentric cam 43 through a stopper 46, which will be described later, so as to interconnect infeeding mechanism A and first wheel carrier table 3.

Stopper 46 is connected to the piston rod 47*a* of a hydraulic cylinder 47 by way of a parallel pair of leaf spring 48, so as to locate first wheel carrier table 3 at a location where stopper 46 is inserted between rod 44 and cam 43 when grinding wheel 28*a* grinds the inner tapered portion "b" of workpiece W.

Figure 11:
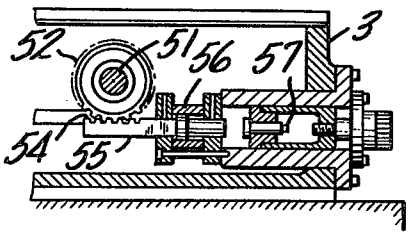
FIG. 11 is a sectional view showing a dressing infeed driving mechanism for taper dressing.

On the upper portion of infeeding shaft 40 there is fixed a worm wheel 49 as shown in FIGS. 5 and 9, so as to infeed grinding wheel 28*a* for dressing. Worm wheel 49 meshes with a worm 50 which is fixed securely on a shaft 51, shaft 51 being supported rotatable in first wheel carrier table 3 in a perpendicular direction with infeeding shaft 40. Shaft 51 is provided with a pinion 52 through a one-way clutch 53, which is loosely mounted on shaft 51, pinion 52 meshing with a rack 54 which is formed on a piston rod 55 of a hydraulic cylinder 56 mounted on first wheel carrier table 3 as shown in FIG. 11, so that one reciprocation of piston rod 55 rotates infeeding shaft 40 intermittently in one rotary direction, rotating eccentric disc cam 43 by desired angles. In the rear space of piston rod 55 there is adjustably mounted a metal contact lug 57 facing the rear end of piston rod 55 on first wheel carrier table 3, so as to determine the piston rod stroke, i.e. a dressing depth.

An end of shaft 51 is protruded out through first wheel carrier table wall, a dial knob 58 being fixed on the shaft end, so that dressing depth may be adjusted with mannual operation. The mannual dressing depth adjusting mechanism includes a clump rod 59 having a tapered end and a clump knob 59*a*, rod 59 being screwed into shaft 51 with its tapered end near one-way clutch 53, and an elastic expanding member 60 having a split engaging with the tapered end of clump rod 59 and outer surfaces engaging with the inner surface of one-way clutch 53, expanding member 60 being inserted loosely in a hole of shaft 51 perpendicular with its axis. Fastening clump knob 59*a*, clump knob 59*a* expands elastic expanding member 60 to fix shaft 51 to one-way clutch 53 so that automatic infeed may be performed with hydraulic cylinder 56, and loosing clump knob 59*a*, shaft 51 is disengaged from one-way clutch 53 so that dial knob 58 is ready to operate mannual infeed.

Shaft 51 further has a spur gear 61 securely fixed thereon, spur gear 61 meshing with a gear 62 which is mounted on the shaft of an electric motor 63, so as to quickly return eccentric disc cam 43 to its initial rotary position when it is advanced up at the full rotation. Reference numeral 64*a* is a potentiometer mounted on infeeding shaft 40 for detecting wheel wear of grinding wheel 28*a*. Reference numeral 64*b* in FIG. 9 is another potentiometer mounted on the lower end of infeeding shaft 29 for detecting infeed position of first wheel carrier table 3.

Figure 12:
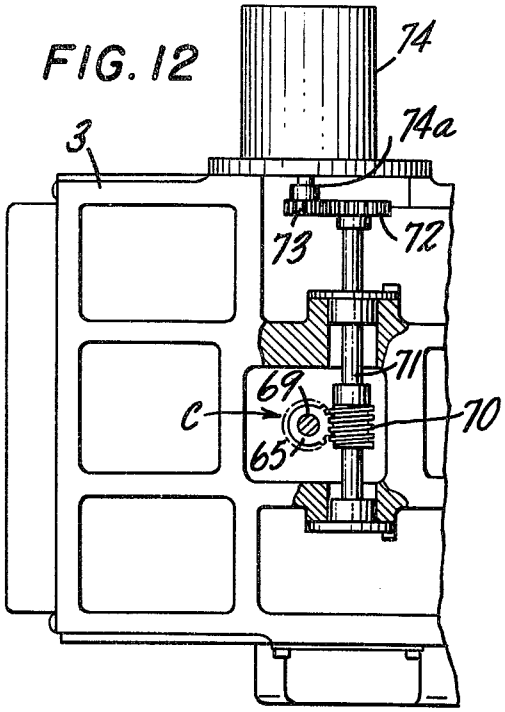
FIG. 12 is a plan view showing a reciprocating mechanism for the second wheel carrier table.

Reciprocating mechanism C, in FIG. 9, is used for reciprocating second wheel carrier table 16, including a reciprocating shaft 65 coaxial with the rotary axis of second wheel carrier table 16 and rotatably mounted on bracket 66 which is fixed on first wheel carrier table 3. An eccentric disc cam 67 is fixed on the top of reciprocating shaft 65 which is protruded from first carrier table board, eccentric disc cam 67 being engaged with a cam-follower 68 which is mounted on the lower side of second wheel carrier table 16, as shown in FIG. 8. On the lower portion of reciprocating shaft 65 there is mounted a worm wheel 69 which meshes with a worm 70 fixed on a shaft 71, shaft 71 being supported rotatable in first wheel carrier table 3 as shown in FIG. 12. Shaft 71 further has a gear 72 which meshes with a gear 73 mounted on the shaft 74*a* of an electric motor 74. Thus, motor 74 gives reciprocating movement on second wheel carrier table 16.

Figure 13:
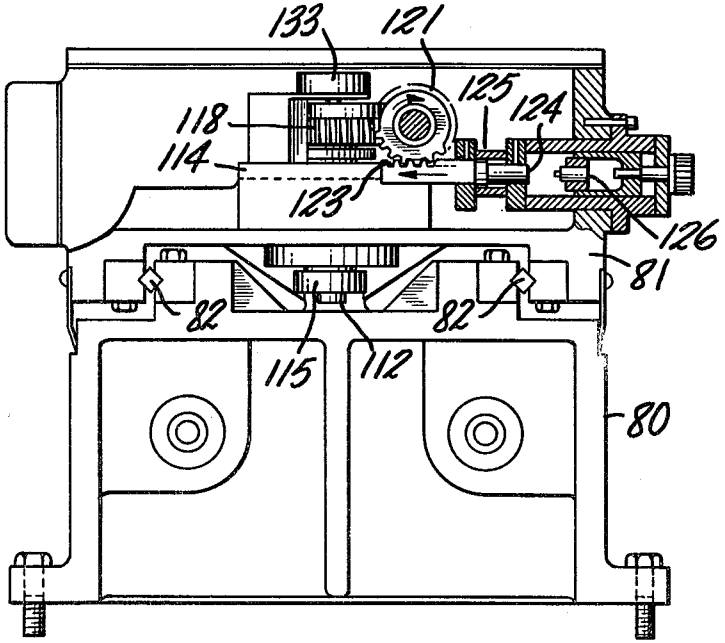
FIG. 13 is a sectional view showing a shift infeed table.
Figure 14:
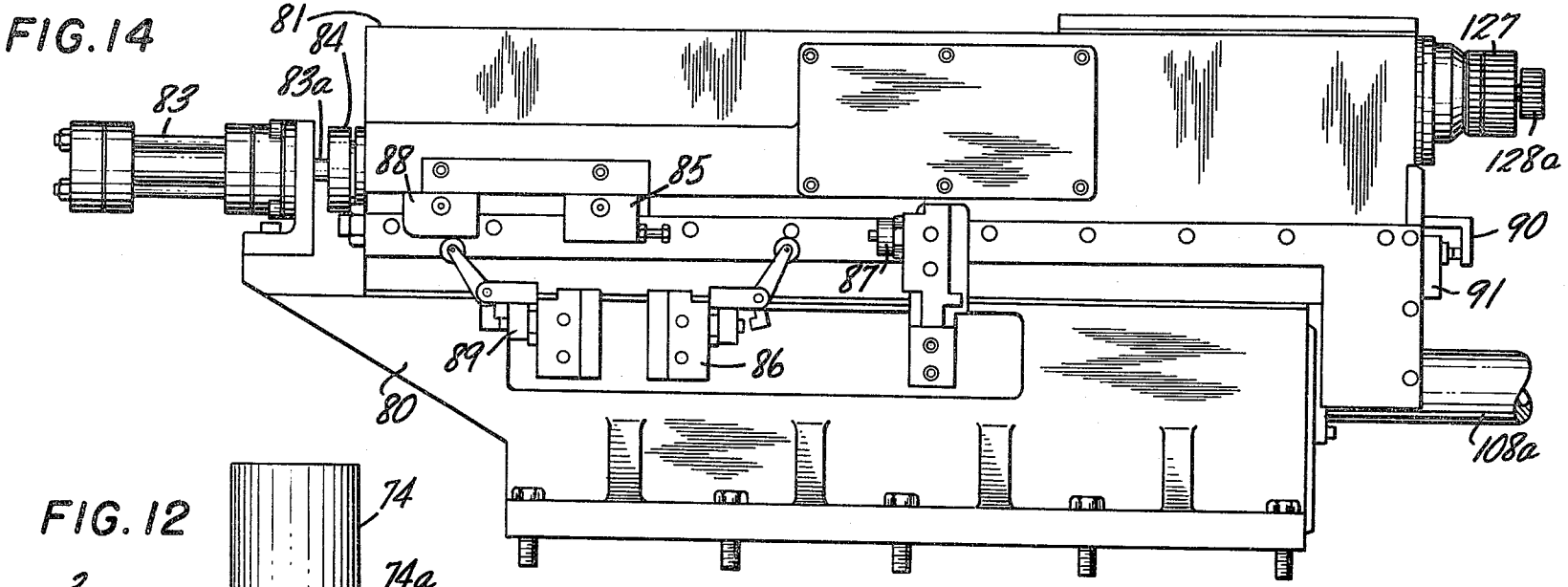
FIG. 14 is a left side view of the shift infeed table.

Referring again to FIGS. 1 and 2, reference numeral 80 designates a table stand spaced in front of table stand 2 on bed 1, a shift infeed table 81 being mounted by way of roller guiding members 82, as shown in FIG. 13, slidable in a perpendicular direction with first wheel carrier table sliding. A hydraulic cylinder 83 is mounted on a side wall of table stand 80 as shown in FIG. 14, the piston rod 83*a* being connected to shift infeed table 81 through a connecting member 84, so as to reciprocate shift infeed table 81. On a side of shift infeed table 81 there are mounted adjustably a dog 85, which operates a limit switch 86 for detecting a speed-down position in the forward shift infeed table stroke and a limit switch 87 for detecting the forward end of the stroke, and a dog 88 which operates a limit switch 89 for detecting a speed-down position in the backward shift infeed table stroke. On the right side wall of shift infeed table 81 there is mounted a dog 90 which operates a limit switch for detecting the backward end of the stroke.

Figure 15:
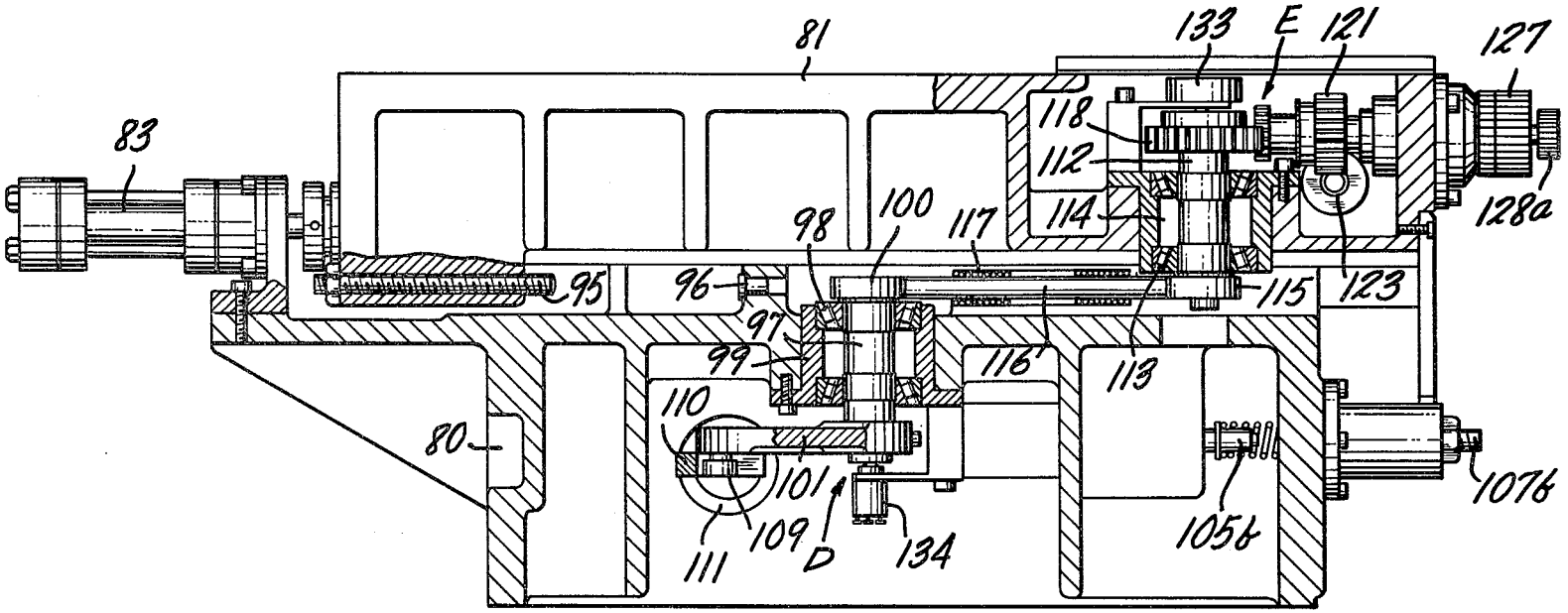
FIG. 15 is a longitudinal sectional view of the shift infeed table.

On the upper surface of shift infeed table 81 there are mounted a work spindle head 92, a driving motor 93 for the work spindle and an automatic loader and unloader 94 for loading a workpiece W on the work spindle, as shown in FIGS. 1 to 3. A screw stopper 95 is screwed in the lower portion of shift infeed table 81 as shown in FIG. 15, for locating shift infeed table 81 so that the work spindle head 92 faces the second wheel spindle 28. Making stopper 95 in contact to a stopper receiver 96 which is fixed on table stand 80, wheel spindle 28 is relatively located in a proper position when inner tapered portion "b" of workpiece W is to be ground.

Figure 16:
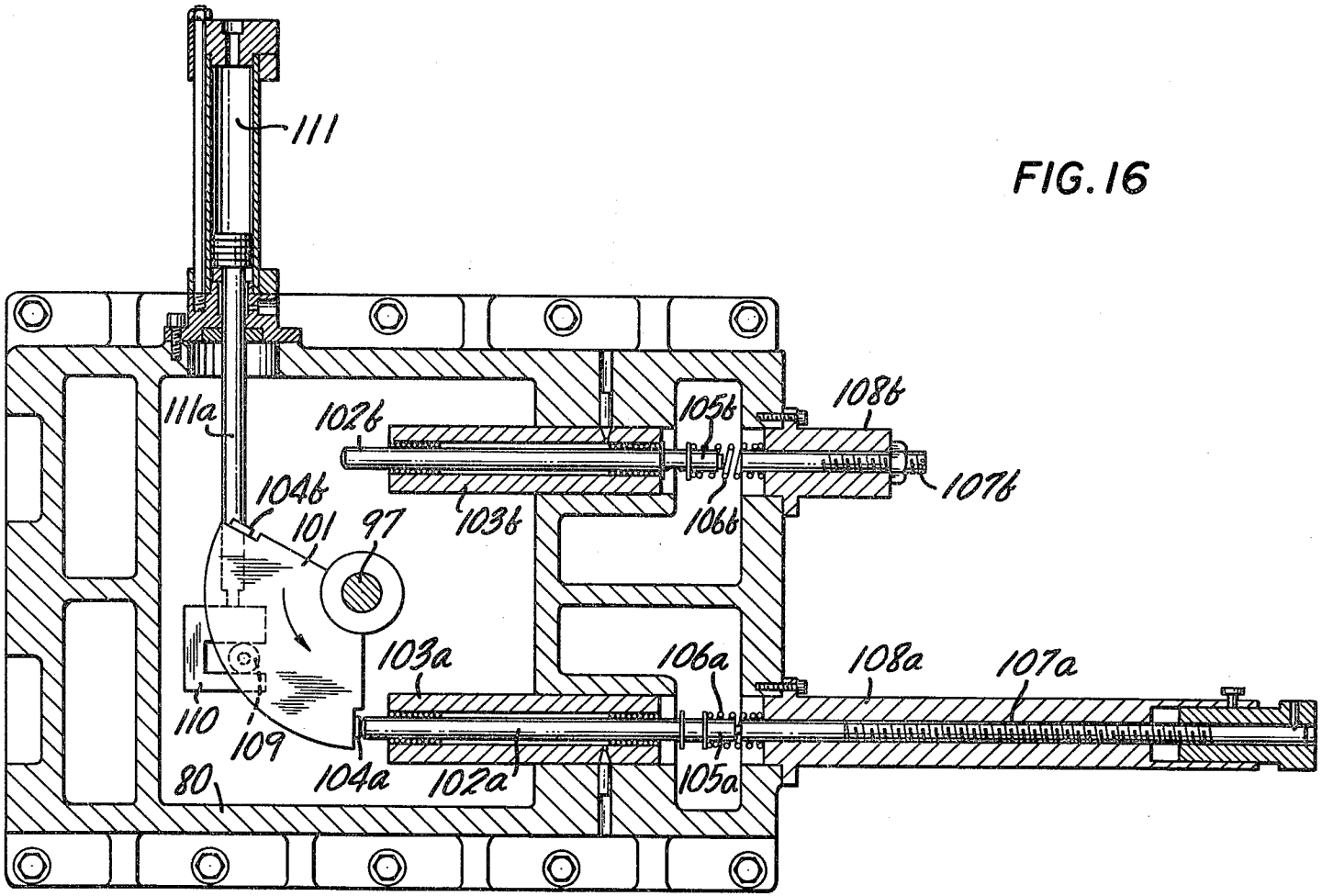
FIG. 16 is a sectional plan view showing an infeeding mechanism for the shift infeed table.

Reference marks D and E in FIG. 15 respectively designate an infeeding mechanism for grinding inner cylindrical portion "a" of workpiece W and a dressing infeed mechanism for dressing a grinding wheel 27*a* used for cylindrical portion "a". Infeeding mechanism D includes an infeeding shaft 97 rotatably supported through bearings 98 by a bracket 99 which is fixed on table stand 80, an eccentric disc cam 100 fixed on the top of infeeding shaft 97, a sector plate 101 fixed on the lower portion of infeeding shaft 97, and sliding rods 102*a* and 102*b* mounted on table stand 80 through guide sleeves 103*a* and 103*b* to determine the rotary stroke of sector plate 101, i.e. infeeding amount, an end of each of sliding rods 102*a* and 102*b* facing to a stopper receiver 104*a* or 104*b* which is fixed on a side of sector plate 101, which is shown in FIG. 16. Metal contacts 105*a* and 105*b* are respectively formed on the other ends of sliding rods 102*a* and 102*b* which project out from guide sleeves 103*a* and 103*b*, compressed coiled springs 106*a* and 106*b* forcing sliding rods 102*a* and 102*b* towards sector plate 101 respectively. Screw stoppers 107*a* and 107*b* are screwed respectively in sleeves 108*a* and 108*b* which are fixed on a wall of table stand 80, an end of each of screw stoppers 107*a* and 107*b* facing the corresponding metal contact 105*a* or 105*b*, so as to energize a timer for spark-out step of inner cylindrical grinding when sliding rod 102*a* is pushed to be in contact with stopper 107*a* by a secter plate swing motion, and as to start inner cylindrical grinding when sliding rod 102*b* is in turn pushed to be in contact with stopper 107*b* by a sector plate back swing motion. Sector plate 101 has a pin 109 protruded from the middle on the sector arc, pin 109 being held by a fork 110 which is securely fixed on the top end of a piston rod 111*a* of a hydraulic cylinder 111 on a side wall of table stand 80, so that hydraulic cylinder 111 drives infeeding shaft 97 to rotate with eccentric disc cam 100 thereby infeeding shift infeed table 81.

Dressing infeed mechanism E for a dresser which dresses a grinding wheel 27*a* of first wheel spindle 27 includes an infeeding shaft 112 which is supported rotatable and vertical with bearings 113 in a bracket 114, bracket 114 being fixed on shift infeed table 81. Infeeding shaft 112 has an eccentric disc cam 115 securely fixed on the bottom end of it. A transmitting rod 116 is supported slidable by sliding bearings 117 in table stand 80, between eccentric disc cam 115 and eccentric disc cam 100 of infeeding mechanism D, transmitting rod 116 being in contact with eccentric disc cam 110 and 115 so as to interconnect infeeding mechanism D and shift infeed table 81.

On the upper portion of infeeding shaft 112 there is fixed a worm wheel 118 as shown in FIGS. 15 and 17, which meshes with a worm 119 which is fixed securely on a shaft 120, shaft 120 being supported rotatable in shift infeed table 81 in a perpendicular direction with infeeding shaft 112. Shaft 120 is provided with a pinion 121 through a one-way clutch 122, which is loosely mounted on shaft 112, pinion 121 meshing with a rack 123 which is formed on a piston rod 124 of a hydraulic cylinder 125 mounted on shift infeed table 81 as shown in FIG. 13, so that one reciprocation of piston rod 124 rotates infeeding shaft 112 intermittently in one rotary direction, rotating eccentric disc cam 115 by desired angles. In the rear space of piston rod 124 there is adjustably mounted a metal contact lug 126 facing the rear end of piston rod 124 on shift infeed table 81, so as to determine the piston rod stroke, i.e. a dressing depth.

An end of shaft 120 is protruded out through shift infeed table 81, a dial knob 127 being fixed on the shaft end so that dressing depth may be adjusted with manual operation. The manual dressing depth adjusting mechanism includes a clump rod 128 having a tapered end and a clump knob 128*a*, rod 128 being screwed into shaft 120 with its tapered end near one-way clutch 122, and an elastic expanding member 129 having a split engaging with the tapered end of clump rod 128 and outer surfaces engaging with the inner surface of one-way clutch 122, expanding member 129 being inserted loosely in a hole of shaft 120 perpendicular with its axis. Fastening clump knob 128*a*, clump knob 128*a* expands elastic expanding member 129 to fix shaft 120 to one-way clutch 122 so that automatic infeed may be performed with hydraulic cylinder 125, and loosing clump knob 128*a*, shaft 120 is disengaged from one-way clutch 122 so that dial knob 127 is ready to operate manual infeed.

Shaft 120 further has a spur gear 130 securely fixed thereon, spur gear 130 meshing with a gear 131 which is mounted on the shaft of an electric motor 132, so as to quickly return eccentric disc cam 115 to its initial rotary position when it is advanced up at the full rotation. Numeral 133 is a potentiometer mounted on infeeding shaft 112 for detecting wheel wear (or wheel diameter) of grinding wheel 27*a*. Numeral 134 in FIG. 15 is another potentiometer mounted on the lower end of infeeding shaft 97 for detecting infeed position of shaft infeed table 81.

Reference numeral 135 shown in FIGS. 2 and 18 designates a frame mounted on shift infeed table 81, frame 135 being spaced between work spindle head 92 and its driving motor 93. A dresser arm 136 is rotatably mounted on a shaft 137 which projects from frame 135 toward grinding wheel spindles 27 and 28. The piston rod 138*a* of hydraulic cylinder 138, which is pivotally supported on frame 135 at its rear portion, is connected to dresser arm 136 with a pivot so as to rotate dresser arm 136.

A pair of dressers 139 and 140 are mounted on the other side of dresser arm 136, one dresser 139 being used for dressing grinding wheel 27*a* and the other 140 being for dressing grinding wheel 28*a*.

Referring again to FIG. 6, reference numerals 141 and 142 are dogs which are adjustably fixed on front wall of first wheel carrier table 3 so as to control its reciprocation movement. On table stand 2 there are mounted limit switches 143 and 144 through a supporter 145, limit switches 143 and 144 being alternately operated by dogs 141 and 142, which controls the hydraulic system for cylinder 5 so as to reciprocate first wheel carrier table 3 for inner cylindrical grinding of workpiece W.

Further, dogs 146 and 147 are adjustably mounted on the front wall of first wheel carrier table 3, so as to respectively operate limit switches 148 and 149 mounted on supporter 145. Limit switches 148 and 149 are alternately operated to control the hydraulic system so that first wheel carrier table 3 is reciprocated when grinding wheel 27*a* is dressed.

In operation of this embodiment, when workpieces W as shown in FIG. 19 are to be ground at both inner cylindrical portion "a" and inner tapered portion "b" with concentricity, swivel table 12 is at first swivelled till the cross angle of first wheel carrier table sliding direction and second wheel carrier table sliding direction coincides with half angle $\alpha$ of the inner taper.

Next, wheel head 22 is swivelled in the opposite direction to the above swivel of swivel table 12, till the axes of wheel spindles 27 and 28 become in parallel to that of work spindle head 92.

Then, first wheel carrier table 3 is advanced by operation of cylinder 5 and when dog 147 operates limit switch 149, cylinder 138 in FIG. 18 rotates dresser arm 136 so as to arrange dresser 139 to a position ready to dress the advancing wheel 27*a*. At the same time, cylinder 125 in FIG. 17 rotating eccentric disc cam 115 by a predetermined angle through pinion 121, shaft 120, worm gears 118 and 119 and infeeding shaft 112, thereby advancing shift infeed table 81 about 10 $\mu$m. for dressing. Further first wheel carrier table advancing effects dressing of wheel 27*a* with dresser 139. When dog 146 operates limit switch 148, first wheel carrier table 3 is moved backward and vice versa when dog 147 operates limit switch 149, during dressing operation. Shift infeed table 81 is advanced to infeed for dressing, a little step by step at every reciprocating cycle of first wheel carrier table.

After dressing of wheel 27*a*, dresser arm 37 is returned back and first wheel carrier table 3 is quickly advanced by operation of cylinder 5, grinding wheel 27*a* on wheel spindle 27 being inserted into the bore of workpiece W which is held in work spindle head 92. Then, first wheel carrier table 3 is reciprocated by hydraulic cylinder 5, the reciprocating stroke being limited in a range which is made by operations of dogs 141 and 142 on limit switches 143 and 144.

Together with reciprocating movement of first wheel carrier table 3 or wheel spindle 27, cylinder 111 of infeeding mechanism D in FIG. 16 drives its piston rod 111*a* to advance, rotating sector plate 101 in the arrow direction. Eccentric disc cam 100 is accordingly rotated, effecting an infeed on shift infeed table 81 through transmitting rod 116 and disc cam 115, and thereby inner cylindrical portion "a" of workpiece W is ground with rough infeed, and then, with fine infeed. When sector plate 101 pushes sliding rod 102*a* and metal contact 105*a* becomes in contact with stopper 107*a*, infeeding movement of shift infeed table 81 is stopped and, at the same time, a timer for spark-out is energized. When the timer is timed up, cylinder 111 returns backward, rapidly returning shift infeed table 81. With contact of metal contact 105*b* to stopper 107*b* according to the sector plate reverse rotation and pushing operation on sliding rod 102*b*, shift infeed table 81 is stopped and the inner taper grinding process, which will be described later, is ready to be started.

First wheel carrier table 3 is quickly returned by cylinder 5 after the inner cylindrical grinding, till disc cam 43 of dressing infeed mechanism B in FIG. 9 comes in contact with a stopper 150. Then, hydraulic cylinder 83 in FIG. 15 moves shift infeed table 81 to advance till stopper 95 becomes in contact with its receiver 96, thereby workpiece W on work spindle head 92 being located facing second wheel spindle 28.

Following to the above inner cylindrical grinding process, inner taper grinding will be performed.

Hydraulic cylinder 18 in FIG. 8 reciprocates second wheel carrier table 16 in angular direction $\alpha$ from first wheel carrier table axis, dresser arm 136 being again set for dressing by cylinder 138, while hydraulic cylinder 56 in FIG. 11 reciprocates pinion 52, thereby rotating eccentric disc cam 43 by a predetermined angle through shaft 51, worm gears 49 and 50, and infeeding shaft 40. Accordingly, first wheel carrier table 3 is advanced, for example, by 10 $\mu$m. as a dressing infeed for dressing of grinding wheel 28*a*. Thus, wheel 28*a* is dressed by dresser 140 during second wheel carrier table reciprocation accompanied by dressing infeed at every reciprocating cycle, to be formed conical in half angle of $\alpha$ degrees.

After this dressing operation, dresser arm 136 is returned back and second wheel carrier table 16 is forced to go forward. Then, hydraulic cylinder 5 drives first wheel carrier table 3 forward while stopper 46 in FIG. 9 is driven upward by cylinder 47. Stopper 46 is inserted between transmitting rod 44 and eccentric disc cam 43, thereby first wheel carrier table 3 being located at a position where disc cam 43 is in contact with stopper 46 and grinding wheel 28*a* of wheel spindle 28 is placed close to inner taper "b" of workpiece W. Then, motor 74 in FIG. 12 starts to rotate eccentric disc cam 67 through reciprocating shaft 65, so that second wheel carrier table 16 is reciprocated in response to the disc cam rotation, cam-follower 68 being pressed toward the disc cam 67 by cylinder 18.

Cylinder 39 of infeeding mechanism A in FIG. 10 rotates sector plate 33 in the arrow direction, rotating eccentric disc cam 32. Accordingly, first wheel carrier table 3 is moved forward as infeed movement for the inner taper grinding, disc cam 43 being pressed toward the cam 32 through transmitting rod 44 and stopper 46 by cylinder 5. Thus, inner tapered portion "b" of workpiece W is ground with rough infeed, and then, with fine infeed. When sector plate 33 pushes stopper 34*b*, first wheel carrier table 3 is stopped and the inner taper grinding is finished.

When the inner taper grinding is finished, first wheel carrier table 3 is quickly returned back by cylinder 5 and sector plate 33 is returned by cylinder 39. Then, shift infeed table 81 and second wheel carrier table 16 are respectively returned back by cylinders 83 and 18, stopper 46 being returned down by cylinder 47.

The finished workpiece is unloaded by unloader 94 from work spindle head 92 and another raw workpiece is then loaded.

Thus, one grinding cycle of workpiece W is completed.

What is claimed is:

1. An internal grinding machine comprising: a base; a first wheel carrier table slidably mounted on said base and slidable along a first axis; a second wheel carrier table mounted on said first wheel carrier table and being mounted for slidable movement along a second axis and having a plurality of grinding wheel spindles mounted thereon; a shift infeed table slidably mounted on said base and slidable along a third axis disposed at an angle with respect to said first axis and supporting thereon a work spindle head for holding a workpiece; means for selectively advancing said shift infeed table along said third axis so as to selectively position the workpiece held on said work spindle head adjacent and facing respective ones of said grinding wheel spindles; an infeeding mechanism mounted on said base operable after said shift infeed table has positioned the workpiece adjacent and facing a first one of said grinding wheel spindles to effect infeeding movement of said shift infeed table to thereby effect infeeding of the workpiece held on said work spindle head along said third axis relative to said first one of said grinding wheel spindles whereby a first grinding operation can be performed on the workpiece; and another infeeding mechanism mounted on said base operable after said shift infeed table has positioned the workpiece adjacent and facing a second one of said grinding wheel spindles to effect infeeding movement of said first wheel carrier table along said first axis to thereby effect infeeding of said second one of said grinding wheel spindles relative to the workpiece held on said work spindle head whereby a second grinding operation can be performed on the workpiece.

2. An internal grinding machine as claimed in claim 1; further including first and second dressers mounted on said shift infeed table; a first dressing infeed mechanism operable to effect movement of said first wheel carrier table in its sliding direction to thereby effect infeeding of the first wheel spindle relative to said first dresser; and a second dressing infeed mechanism operable to effect movement of said shift infeed table in its sliding direction to thereby effect infeeding of the second wheel spindle relative to said second dresser.

3. An internal grinding machine as claimed in claim 1; further including a swivel table mounted on said first wheel carrier table and having said second wheel carrier table mounted thereon; and wherein said second wheel carrier table is provided with a reciprocating mechanism which includes an eccentric cam mounted rotatably on said swivel table, the axis of the cam shaft being arranged in a perpendicular direction to the second wheel carrier sliding direction and being coaxial with the swivel axis of said swivel table, and a cam-follower mounted on said second wheel carrier table and being in contact with said eccentric cam.

4. An internal grinding machine as claimed in claim 3; further including a cylindrical grinding wheel mounted on said first one of said grinding wheel spindles and a tapered grinding wheel mounted on said second one of said grinding wheel spindles.

5. An internal grinding machine as claimed in claim 1; further including a cylindrical grinding wheel mounted on said first one of said grinding wheel spindles and a tapered grinding wheel mounted on said second one of said grinding wheel spindles.

6. An internal grinding machine as claimed in claim 1; including means mounting said second wheel carrier table for angular swivelling movement atop said first wheel carrier table.

* * * * *